US011644038B2

(12) United States Patent
Da Silva Castro et al.

(10) Patent No.: US 11,644,038 B2
(45) Date of Patent: May 9, 2023

(54) END ELEMENT FOR THE STATOR OF AN ELECTRIC MOTOR OF A HERMETICALLY SEALED REFRIGERANT COMPRESSOR

(71) Applicant: Secop GmbH, Flensburg (DE)

(72) Inventors: Mattias Da Silva Castro, Graz (AT); Thomas Saars, Großenwiehe (DE); Vladimir Svajda, Surany (SK)

(73) Assignee: SECOP GMBH, Flensburg (DE)

( * ) Notice: Subject to any disclaimer, the term of this patent is extended or adjusted under 35 U.S.C. 154(b) by 248 days.

(21) Appl. No.: 17/094,497

(22) Filed: Nov. 10, 2020

(65) Prior Publication Data

US 2021/0140439 A1 May 13, 2021

(30) Foreign Application Priority Data

Nov. 13, 2019 (EP) ..... 19208869

(51) Int. Cl.
*F04D 25/06* (2006.01)
*F04D 29/40* (2006.01)
(Continued)

(52) U.S. Cl.
CPC ..... *F04D 25/06* (2013.01); *F04B 39/0044* (2013.01); *F04D 29/403* (2013.01);
(Continued)

(58) Field of Classification Search
CPC ..... F04B 39/14; F04B 35/04; F04B 39/0044; F04B 53/001; F04B 25/06; F04B 9/00; F04B 39/127; F04C 29/068
(Continued)

(56) References Cited

U.S. PATENT DOCUMENTS 3,250,461 A * 5/1966 Parker ..... F25B 31/023 324/76.47
4,108,581 A * 8/1978 Miller ..... F04B 39/127 417/363

(Continued)

FOREIGN PATENT DOCUMENTS

| | | |
|---|---|---|
| AT | 009 772 | 3/2008 |
| KR | 10-2011-0089745 | 8/2011 |
| WO | 2017/137328 | 8/2017 |

OTHER PUBLICATIONS

Europe Search Report/Office Action conducted in counterpart Europe Appln. No. 19208869.8-1004 (dated Apr. 22, 2020).

*Primary Examiner* — Nathan C Zollinger
*Assistant Examiner* — Timothy P Solak
(74) *Attorney, Agent, or Firm* — Greenblum & Bernstein, P.L.C.

(57) ABSTRACT

End element for the stator of an electric motor of a hermetically sealed refrigerant compressor including at least one isolating element, having a ring-like core, to cover an axial end portion of the stator and to isolate a stator core and stator windings. The end element includes several spring holders extending radially outside the isolating element, each spring holder being adapted to hold a spring for supporting the electric motor in a housing of the hermetically sealed refrigerant compressor. The spring holders are oriented parallel to the axis of the isolating element and an insertion part of each spring holder extends in a first axial direction beyond the neighboring area of the isolating element. The spring holders and the isolating element are integral parts of the end element. The spring holders are tiltable so that an extended part of a spring holder tilts radially inwards.

17 Claims, 10 Drawing Sheets

(51) Int. Cl.

| | |
|---|---|
| ***F04B 39/00*** | (2006.01) |
| *F04B 39/12* | (2006.01) |
| *F04D 29/66* | (2006.01) |
| *F04B 9/00* | (2006.01) |
| *F04B 53/00* | (2006.01) |

(52) U.S. Cl.
CPC ..... *F04B 9/00* (2013.01); *F04B 39/127* (2013.01); *F04B 53/001* (2013.01); *F04D 29/668* (2013.01)

(58) Field of Classification Search
USPC ..... 310/51
See application file for complete search history.

(56) References Cited

U.S. PATENT DOCUMENTS

| | | | | |
|---|---|---|---|---|
| 5,090,657 | A * | 2/1992 | Dreiman | F16F 7/14 267/179 |
| 5,342,179 | A * | 8/1994 | Dreiman | F16F 3/02 417/363 |
| 5,435,702 | A | 7/1995 | Koyama et al. | |
| 2009/0068030 | A1 | 3/2009 | Valbjoern et al. | |

* cited by examiner

END ELEMENT FOR THE STATOR OF AN ELECTRIC MOTOR OF A HERMETICALLY SEALED REFRIGERANT COMPRESSOR

CROSS-REFERENCE TO RELATED APPLICATION

This application claims priority under 35 U.S.C. § 119(a) of Europe Application No. EP 19208869.8 filed Nov. 13, 2019, the disclosure of which is expressly incorporated by reference herein in its entirety.

FIELD OF THE INVENTION

The present invention relates to an end element for the stator of an electric motor of a hermetically sealed refrigerant compressor,

- whereas the end element comprises at least one isolating element which is adapted to cover an axial end portion of the stator and to isolate a stator core and stator windings,
- whereas the isolating element has a ring-like structure,
- whereas the end element comprises several spring holders, each spring holder being adapted to hold a spring for supporting the electric motor in a housing of the hermetically sealed refrigerant compressor,
- whereas the spring holders extend radially outside the isolating element,
- whereas the spring holders are oriented parallel to the axis of the isolating element and an insertion part of each spring holder extends in a first axial direction beyond the neighbouring area of the isolating element,
- whereas the spring holders and the isolating element are integral parts of the end element.

The present invention also relates to a refrigerant compressor comprising a hermetically sealed housing and a drive unit disposed in the interior of the housing, the drive unit comprising an electric motor with a stator and an end element.

The end element of the present invention is favourably used as a lower end element.

The drive unit of a refrigerant compressor normally comprises a piston/cylinder unit for cyclical compression of a refrigerant, and an electric motor to drive the piston/cylinder unit. The electric motor comprises a stator and a rotor, whereas the rotor, especially an interior permanent magnet rotor, is situated inside the stator.

PRIOR ART

A respective end element is known from US 2009/0068030 A1. To achieve the goal of simplifying the design of the spring mounting the end element (here called end plate) of the stator comprises at least one integrated first spring holder (here called spring retainer). According to US 2009/0068030 A1 it is thus possible, particularly in connection with small compressors whose low refrigeration output only requires a small drive motor, to realise a relatively simply designed spring retainer, in which no additional threaded bores, screws, mounting fittings or the like are required. The spring retainers are made in one piece with the end plate of the stator. The end element is normally made of plastic.

The spring holders disclosed in US 2009/0068030 A1 lie radially outside of the remaining ring-like end element. The stator normally is rigidly connected to the bearing of the shaft and to the piston/cylinder unit. The stator and accordingly the spring holders thus bear the whole weight of the drive unit and the spring holders also have to carry additional load, e.g. due to an acceleration when the compressor is transported within a vehicle, or during start and stop of the compressor. The spring holders transfer the load to spring members, normally helical springs, which spring members are mounted inside the compressor housing and which transfer the load to the compressor housing and/or mounting elements outside the compressor housing for mounting the compressor into a refrigerating unit. So the connection between a spring holder and the remaining end element has to bear not only the weight of the drive unit but also additional load.

OBJECT OF THE INVENTION

It is therefore an object of the invention to provide an end element which is apt to relieve the connection between spring holder and remaining end element from load and/or to give additional support to the spring holder in the loaded state.

PRESENTATION OF THE INVENTION

The invention relates to an end element for the stator of an electric motor of a hermetically sealed refrigerant compressor,

- whereas the end element comprises at least one isolating element which is adapted to cover an axial end portion of the stator and to isolate a stator core and stator windings,
- whereas the isolating element has a ring-like structure,
- whereas the end element comprises several spring holders, each spring holder being adapted to hold a spring for supporting the electric motor in a housing of the hermetically sealed refrigerant compressor,
- whereas the spring holders extend radially outside the isolating element,
- whereas the spring holders are oriented parallel to the axis of the isolating element and an insertion part of each spring holder extends in a first axial direction beyond the neighbouring area of the isolating element,
- whereas the spring holders and the isolating element are integral parts of the end element.

The claimed end element is characterized in that the spring holders are tiltable with relation to the isolating element so that an extended part of a spring holder, which extended part extends in a second axial direction beyond the neighbouring area of the isolating element, can tilt radially inwards so that in the operational state of the end element the extended part of the spring holder can contact a lateral surface of the stator core.

Tiltable here means that the spring holders can be tilted to a certain extent against the isolating element, i.e. until they touch the lateral surface of the stator in the operational state, and the mechanical connection between spring holder and isolating element does not break or get otherwise damaged. So the connection between spring holder and isolating element is an elastic connection. The tilt angle, until the extended part of the spring holder touches the lateral surface of the stator, can be in a range between 1° and 10°, for example between 1° and 5°, preferably between 1° and 3°, more preferably between 1° and 2°. The smaller the tilt angle, the smaller is the stress level in the end element, i.e. in the connection between spring holder and isolating element.

The term "axial" here refers either to the axis of the stator, which axis in the operational state is the same as the axis of the rotor, i.e. the axis of rotation of the rotor, or it refers to the axis of the isolating element, which axis is the same as of the stator when the end element is mounted on the stator. The axis of the isolating element is the axis of mathematical rotation of the ring-like isolating element.

That the isolating element is adapted to cover an axial end portion of the stator means that the isolating element is at least also situated at one axial end of the stator. It can cover the front end of the axial end portion and/or the outer lateral surface of the axial end portion and/or the inner lateral surface of the axial end portion. The isolating element can extend from the end portion further down the axial direction into the stator. The isolating element touches at least the front end of the axial end portion of the stator. The isolating element normally connects to the stator in a form-locking way.

That the isolating element has a ring-like structure means that it has a central opening around its axis and that the isolating element can at least accommodate a cylindrical body inside, here the rotor.

That the spring holders extend radially outside the isolating element means that their position as seen in radial direction is at least partially, normally completely, outside the isolating element. Especially the insertion part is normally completely outside the isolating element.

The first axial direction is the direction parallel to the axis of the isolating element pointing in the direction away from the stator when referring to the mounted status of the end element. The second axial direction is the direction parallel to the axis of the isolating element pointing in the direction to the stator when referring to the mounted status of the end element. So first and second axial directions are anti-parallel.

That the spring holders and the isolating element are integral parts of the end element means that the end element is one-part.

Because the extended part of the spring holder can tilt radially inwards it can touch the lateral surface of the stator in the tilted state, so the lateral surface of the stator supports the extended part which reduces stress in the spring holder and in the connection between spring holder and the remaining end element, i.e. the isolating element. One extended part together with the isolating element in the loaded state act as a bracket to hold the stator in position, since the isolating element contacts the stator at its front end and the extended part contacts the stator at its lateral surface. So the end element helps centering the springs and holds the drive unit in position in lateral direction.

One embodiment of the invention consists in that the spring holder includes a hollow body with at least one stiffening rib inside the hollow body extending from one side wall to the opposing side wall of the hollow body. Due to the hollow form the spring holder is strong and lightweight, and the stiffening rib adds stability.

Preferably the stiffening rib extends radially, so the spring holder is especially stable when tilting radially inwards.

One embodiment of the invention consists in that at the side facing the isolating element a cross section of the extended part has the form of a circular arc. The radius of the circular arc should correspond to the radius of the lateral surface of the stator. Since the lateral surface of the stator normally has a cylindrical form the extended part will contact the lateral surface along its surface and thus transfer load across the whole angular range of the circular arc. The angular range, measured with reference to the ring-like isolating element, can be between 10° and 40°, for example between 25° and 35°. In comparison thereto the angular range which is covered by one insertion part of a spring holder normally is one half to one third of the angular range of the circular arc of the extended part. So the angular range which is covered by one insertion part could be between 3° and 20°, for example around 10°.

That the radius of the circular arc should correspond to the radius of the lateral surface of the stator does not mean that the radius should be the same since in that case it would not be possible to mount the end element to the stator or to tilt the extended part radially inwards.

According to one embodiment of the invention the side of the extended part facing the isolating element is tilted radially outwards by a draft angle so that the radius of the side is growing with growing axial distance from the isolating element. This means that at the bottom of the extended part the radial distance to the stator will be smaller and thus keep the stator in position whereas at the top of the extended part the radial distance to the stator will be larger, allowing the extended part to tilt inwards and embrace the stator in case the refrigerant compressor is loaded. The draft angle should be smaller than the tilt angle, e.g. less than half of the tilt angle.

To further enhance the effect of a large area of contact between extended part and the lateral surface of the stator, the extended part can broaden in the direction radially inwards. So the extended part is broader at the side facing the lateral surface of the stator than at the side facing radially outwards.

One embodiment of the invention consists in that each spring holder is partially enclosed by a rim which extends to a web oriented normal to the axis of the isolating element and additionally connecting the spring holder in a symmetric manner to the isolating element. This helps to add stability when the spring holders are tilted since the area of connection between spring holder and isolating element is enlarged. There can be one continuous rim running round the whole circumference of the isolating element enclosing all spring holders. Or there can be a separate rim for each spring holder extending from the spring holder to the left and to the right on the isolating element and ending on the isolating element. When seen in axial direction, the rim can be positioned between insertion part and extended part.

The present invention also refers to a refrigerant compressor comprising a hermetically sealed housing and a drive unit disposed in the interior of the housing, the drive unit comprising an electric motor with a stator and an end element according to the invention,

- whereas the end element comprises at least one isolating element which covers an axial end portion of the stator and isolates the stator core and the stator windings,
- whereas each spring holder holds a spring which springs support the electric motor in the housing of the hermetically sealed refrigerant compressor,
- whereas the extended parts of the spring holders in a first position with relation to the stator, when the refrigerant compressor is not loaded, each have a radial distance to the lateral surface of the stator core, and
- whereas the extended part of at least one spring holder in a second position with relation to the stator, when the refrigerant compressor is loaded, contacts the lateral surface of the stator core due to a tilt radially inwards form the first position into the second position.

In the unloaded state of the refrigerant compressor the springs and spring holders only have to carry the weight of the drive unit. In a loaded state of the refrigerant compressor the drive unit is moved with relation to the sealed housing. This can be due to the movement of the drive unit during start or stop of the electric motor, or due to an acceleration of the compressor itself, e.g. if it is mounted in a vehicle and the vehicle accelerates or brakes or goes over a bump. Such a load has vertical and horizontal components. Any vertical load component pressing the drive unit vertically down will result in the extended parts of the spring holders contacting the lateral surface of the stator. The spring holders then act as a bracket to hold the stator in its position inside the sealed housing.

Additionally, the spring holders of the end element according to the invention prevent the springs from falling off the spring holders during transport or high start or stop loads of the compressor.

According to one embodiment of the refrigerant compressor the tilt angle between first position and second position is in the range between 1° and 10°, preferably between 1° and 5°, more preferably between 1° and 3°.

According to one embodiment of the refrigerant compressor in the first position the radial distance between extended part of a spring holder and lateral surface of the stator core is less than 1 mm, preferably less than 0.5 mm. The radial distance need not be constant. Since the present invention is best used for small compressors the radial distance must not be too wide in order to keep the position of the stator stabilized. Small compressors here particularly are understood as having a stator diameter of 40-100 mm and a housing diameter of 80-120 mm.

So according to one embodiment of the refrigerant compressor in the first position the radial distance between the extended part of a spring holder and the lateral surface of the stator core is equal to or more than 0.1 mm.

According to one embodiment of the refrigerant compressor in the first position the side of extended part facing the isolating element is tilted radially outwards by a draft angle so that the radius of the side is growing with growing axial distance from the isolating element.

BRIEF DESCRIPTION OF THE FIGURES

The invention will now be explained in greater detail using exemplary embodiments. The drawings are meant as examples and are supposed to present the idea of the invention, but by no means to restrict it or to reproduce it in final manner.

In this regard, the figures show.

DETAILED DESCRIPTION OF THE FIGURES

Figure 1:
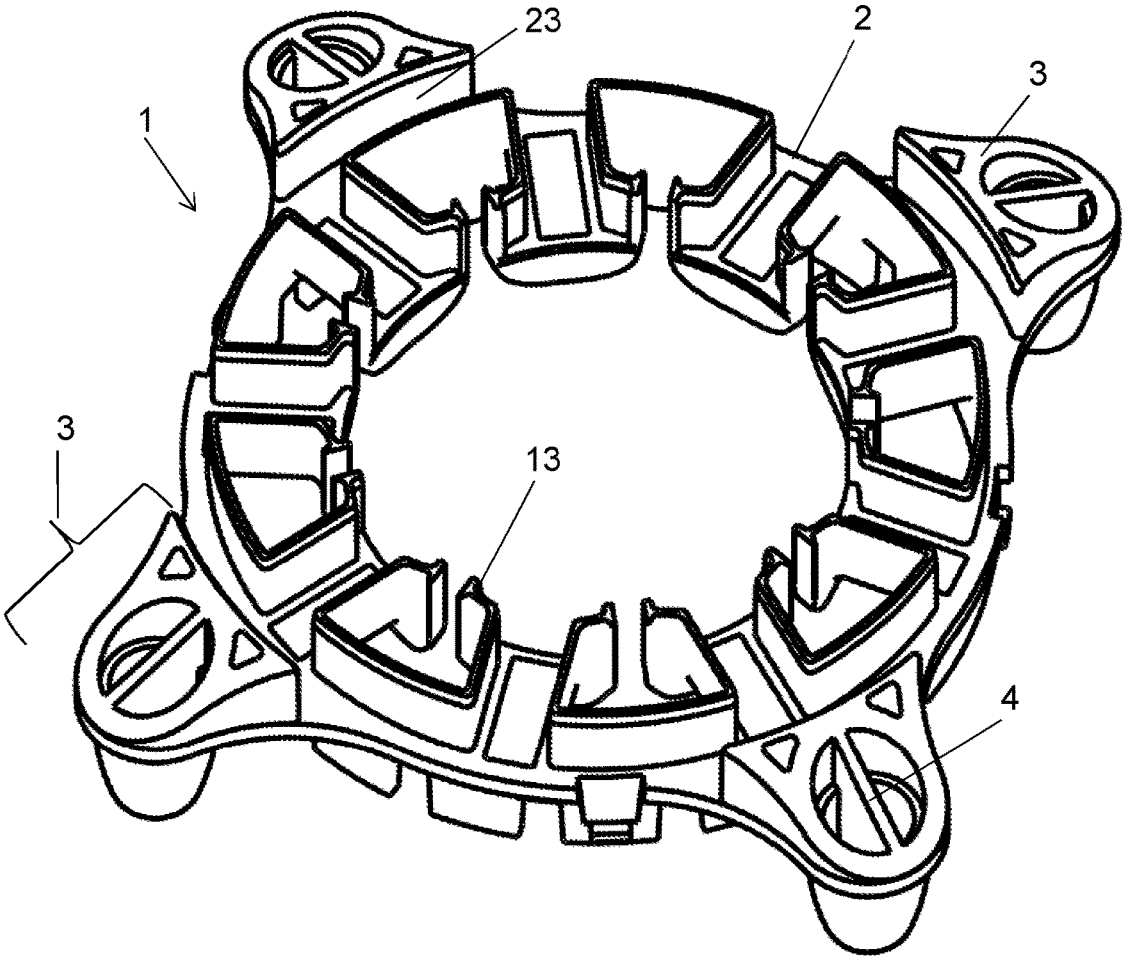
FIG. 1 the perspective view of an end element according to the invention.

FIG. 1 shows an end element 1 comprising one isolating element 2 having a ring-like structure and four spring holders 3. The spring holders 3 are situated radially outside the isolating element 2. The end element 1 is made of plastic as one part. The end element 1 can be made as a plastic injection moulded part. The end element 1 has protrusions 13 oriented radially inward which align the end element 1 to the stator core of stator 14 (for stator 14 see e.g. FIG. 9) and isolate stator core and stator windings. Each spring holder 3 is mainly a hollow body with at least one stiffening rib 4 inside the hollow body extending from one side wall to the opposing side wall of the hollow body. The stiffening rib 4 extends radially with relation to the axis 5 of the isolating element 2, see FIG. 2.

Figure 2:
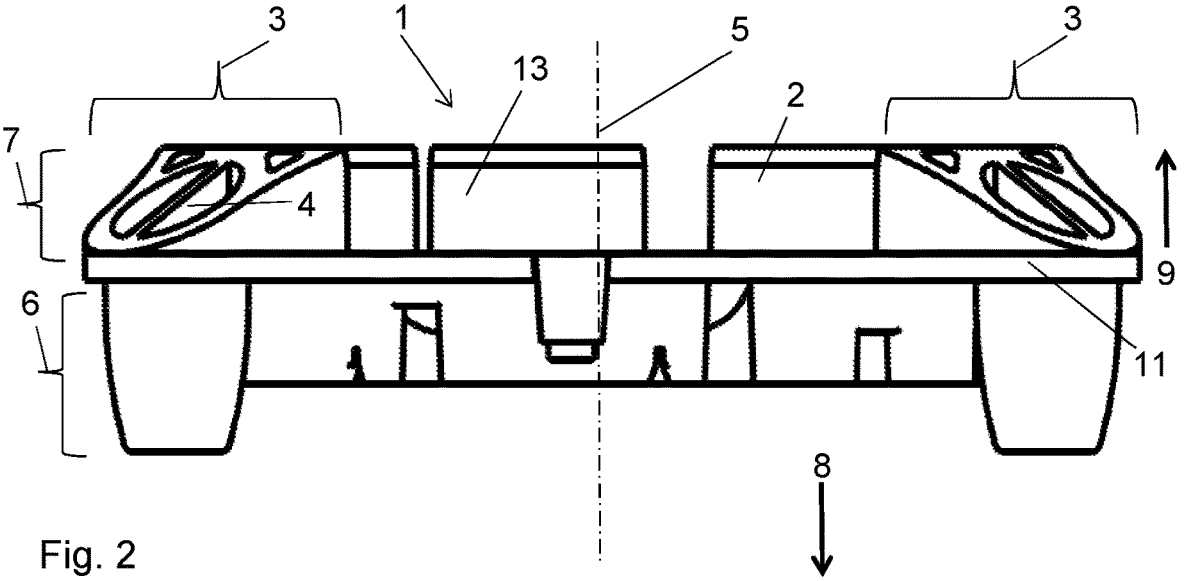
FIG. 2 the side view of the end element of FIG. 1.

The side 23 of the extended part 7 of the spring holder 3, see FIG. 2, facing the isolating element 2 has a cross section in the form of a circular arc.

According to FIG. 2, the spring holders 3 are oriented parallel to the axis 5 of the isolating element 2. The insertion part 6 of each spring holder 3 extends in a first axial direction 8 beyond the neighbouring area of the isolating element 2, which first axial direction 8 is downwards here. Here the second axial direction 9, into which the extended part 7 extends, is upwards. The insertion part 6 can be inserted into a helical spring 10, see FIGS. 9 and 10. Here the stiffening rib 4 extends through the whole spring holder 3 in axial direction, that is from the extended part 7 down to the bottom of insertion part 6.

Figure 3:
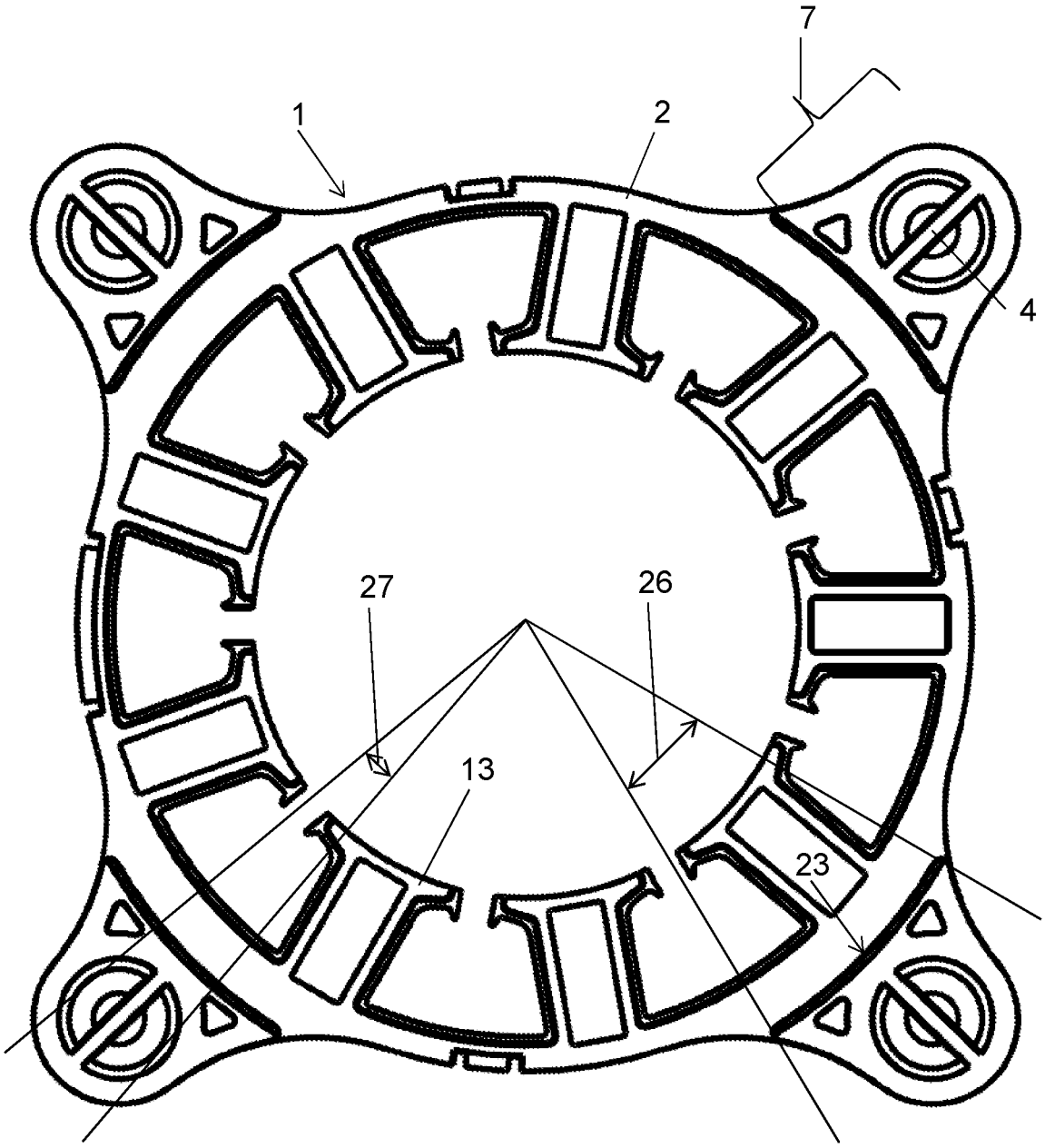
FIG. 3 the top view of the end element of FIG. 1.
Figure 4:
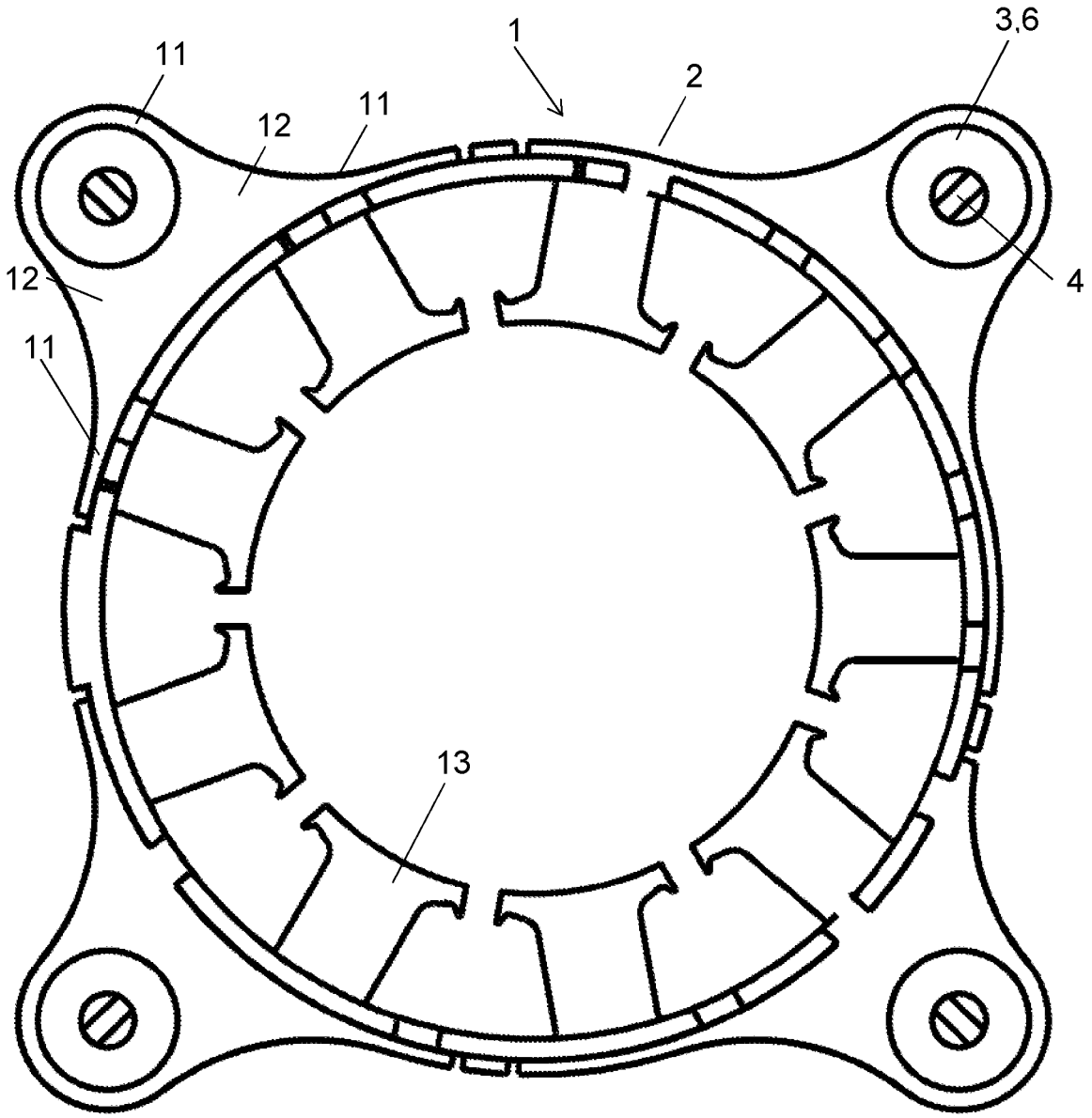
FIG. 4 the bottom view of the end element of FIG. 1.
Figure 5:
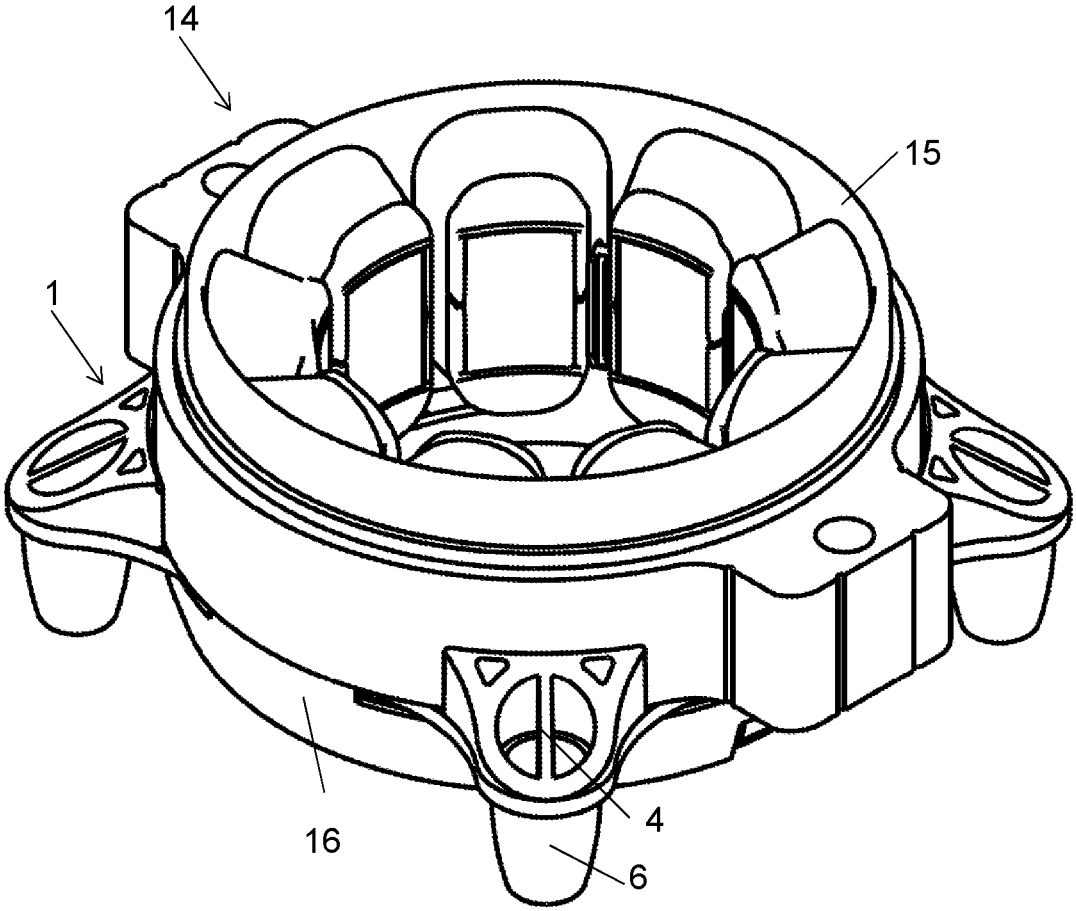
FIG. 5 the perspective view of a stator with an end element of FIG. 1.
Figure 6:
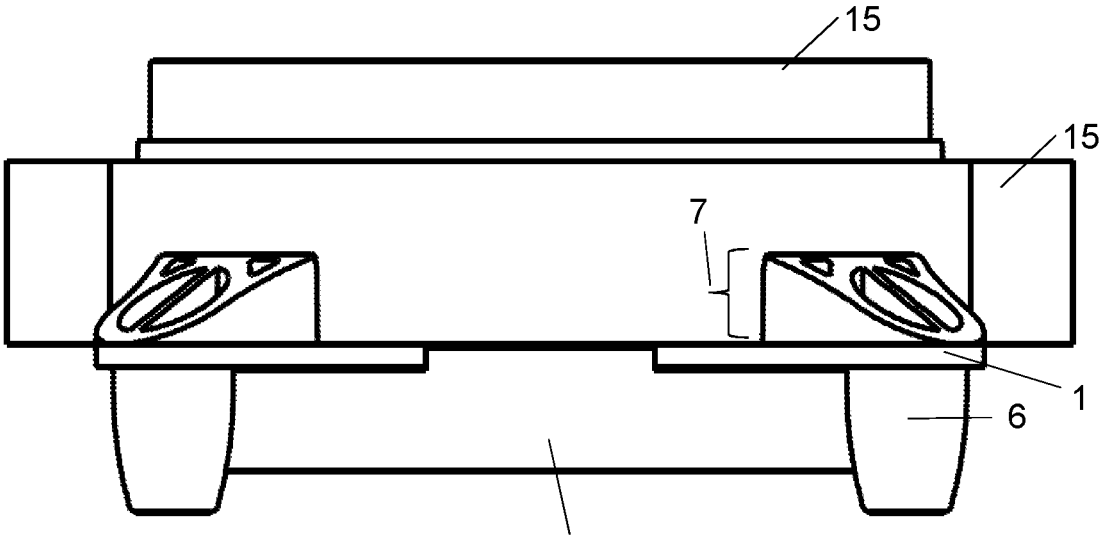
FIG. 6 the side view of the stator of FIG. 5.
Figure 7:
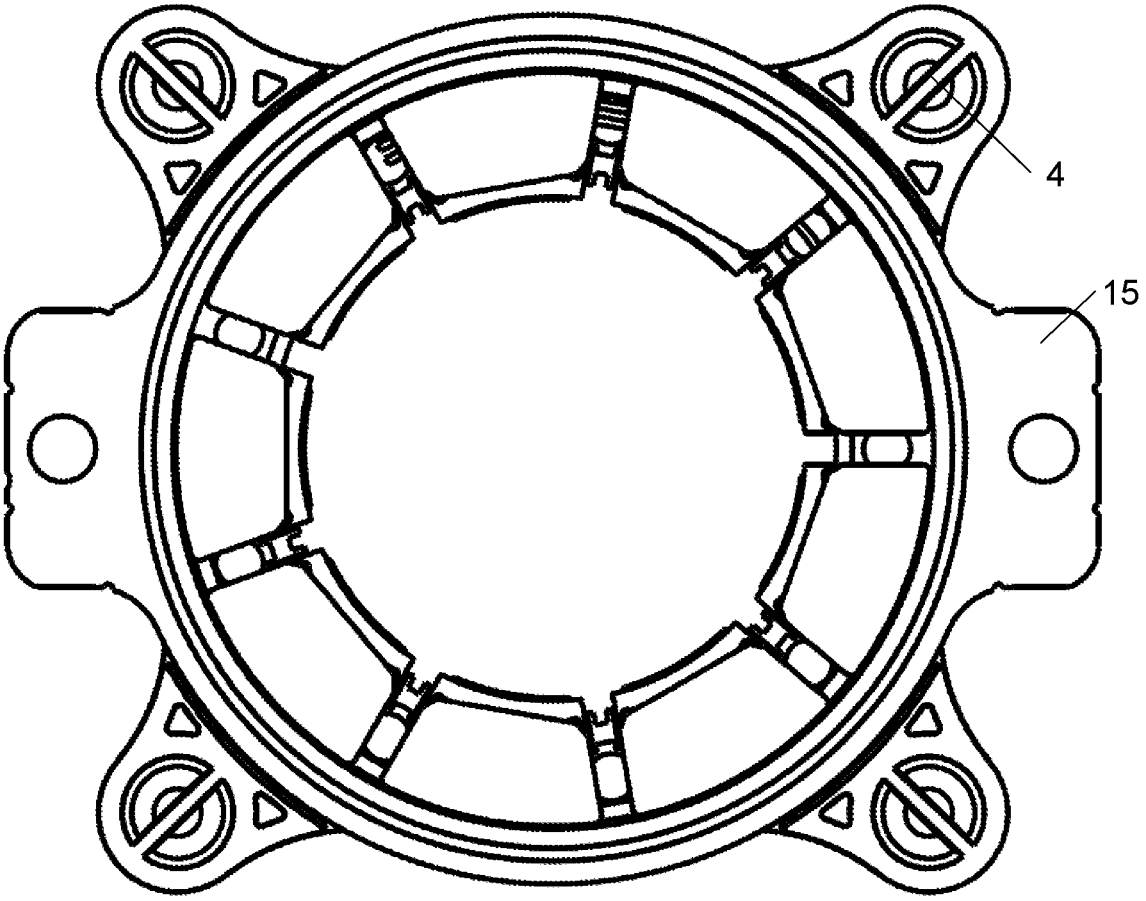
FIG. 7 the top view of the stator of FIG. 5.
Figure 8:
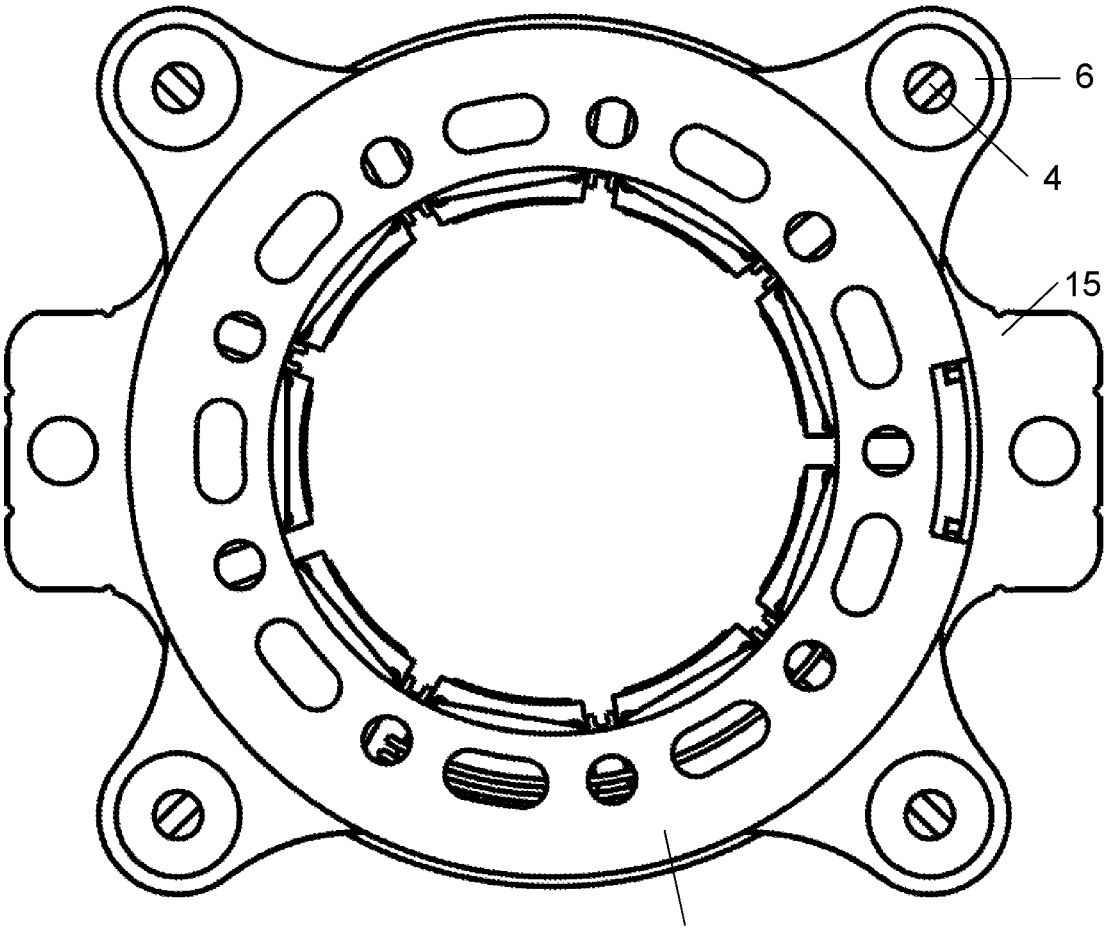
FIG. 8 the bottom view of the stator of FIG. 5.

The extended part 7 broadens in the direction radially inwards, which can be seen best in FIGS. 3 and 4. Each spring holder 3 is partially enclosed by a rim 11 which extends to a web 12 oriented normal to the axis 5 of the isolating element 2 and additionally connecting the spring holder 3 in a symmetric manner to the isolating element 2, that is, web 12 on one side of the spring holder 3 is symmetric to the web 12 on the other side of the spring holder 3. The axis of symmetry would here contain the stiffening rib 4. The rim 11 separates the spring holder 3 in insertion part 6 and extended part 7, see FIG. 2.

In FIG. 3 the angular range 26 of the circular arc of the side 23 of the extended part 7, measured with reference to the ring-like isolating element 2, i.e. with reference to axis 5, here is about 29°. The angular range 27 of the insertion part 6 here is about 10°.

FIG. 5-8 show a stator with an end element 1 according to the invention mounted at one axial end portion of the stator 14, here at the lower end of the stator which is close to the bottom of the refrigerant compressor in the operational status. The stator 14 has a stator core having several pole teeth on its radial inside, said pole teeth being formed by stator webs and salient poles on the inside of the stator opening. In grooves formed between the pole teeth, stator windings are located, each surrounding a stator web. Between the stator core and the stator windings is located an electrical isolation in the form of an upper end element 15 and a lower end element, whereas the lower end element is an end element 1 according to the invention. It is not excluded that additionally the upper end element 15 is made according to the invention. Each end element 1,15 is mounted on an axial end face of the stator core. The two end elements 1,15 are at least very close to each other in the middle of the stator 14. Thus, the two end elements 1,15 form a complete electrical isolation between the stator windings and the stator core. For motors for less than 50 V it is sufficient that the two end elements 1,15 are at least very close to each other. For motors with higher voltage it is favourable that the two end elements 1,15 overlap in the middle of the stator 14. The end elements 1,15 are held at the stator core in a form-fitting manner.

A cover element 16 additionally covers the end element 1 at the bottom. It can be made of plastic and e.g. snapped onto end element 1. Since the electrical connection between the coils of the stator windings of the stator 14 are placed on the outer diameter of the end element 1 the cover element 16 has the function to generate an isolation between these connection wires 28 and the helical springs 10, see FIG. 11.

Figure 9:
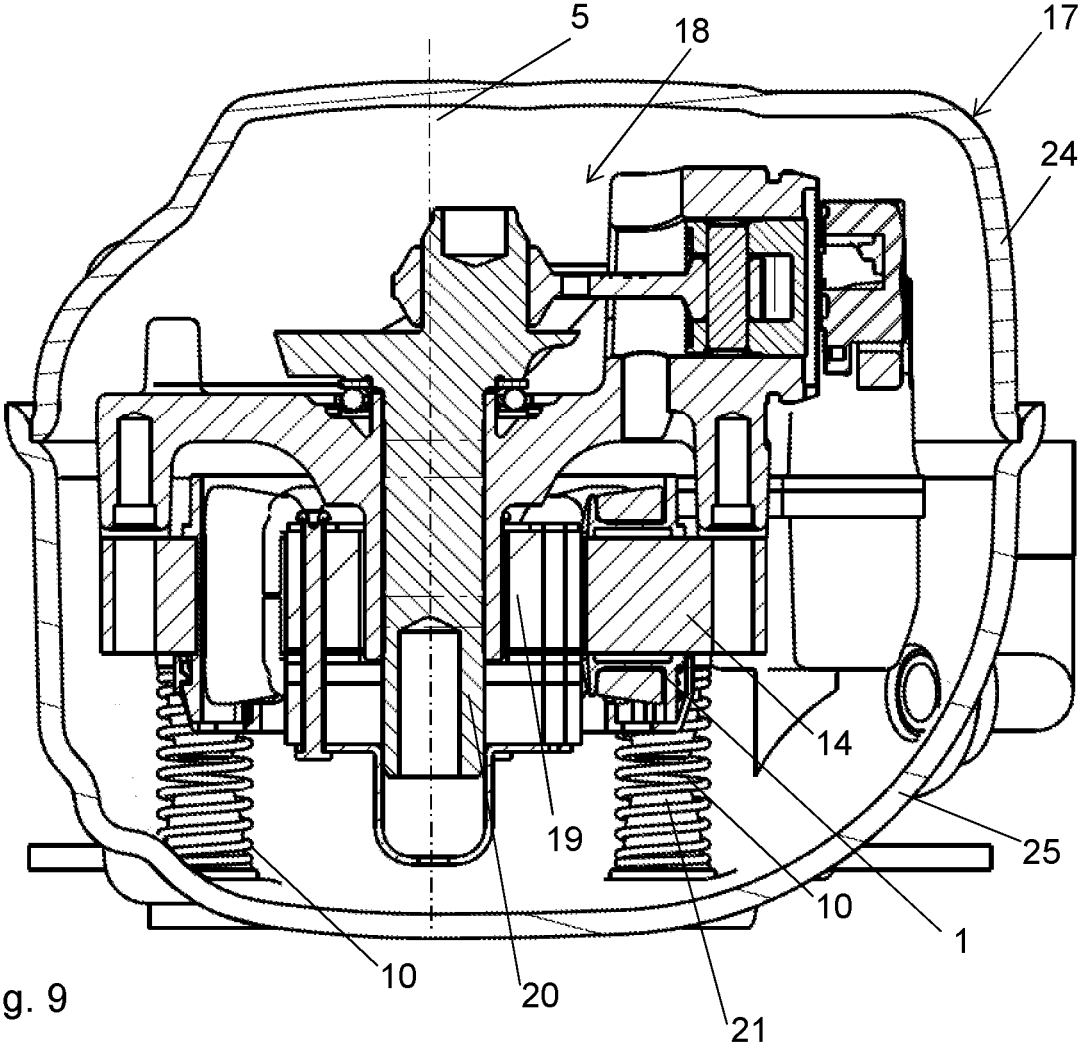
FIG. 9 a longitudinal cross section of a refrigerant compressor with an end element of FIG. 1, the section plane including the axis of the stator but no spring holders, FIG. 10 a longitudinal cross section of a refrigerant compressor with an end element of FIG. 1, the section plane being parallel to the section plane of FIG. 9, going through two spring holders, FIG. 11 a longitudinal cross section of a refrigerant compressor with an end element of FIG. 1, the section plane including the axis of the stator and two spring holders, FIG. 12 a longitudinal section through one spring holder in the unloaded state, FIG. 13 a longitudinal section through one spring holder in the loaded state.
Figure 10:
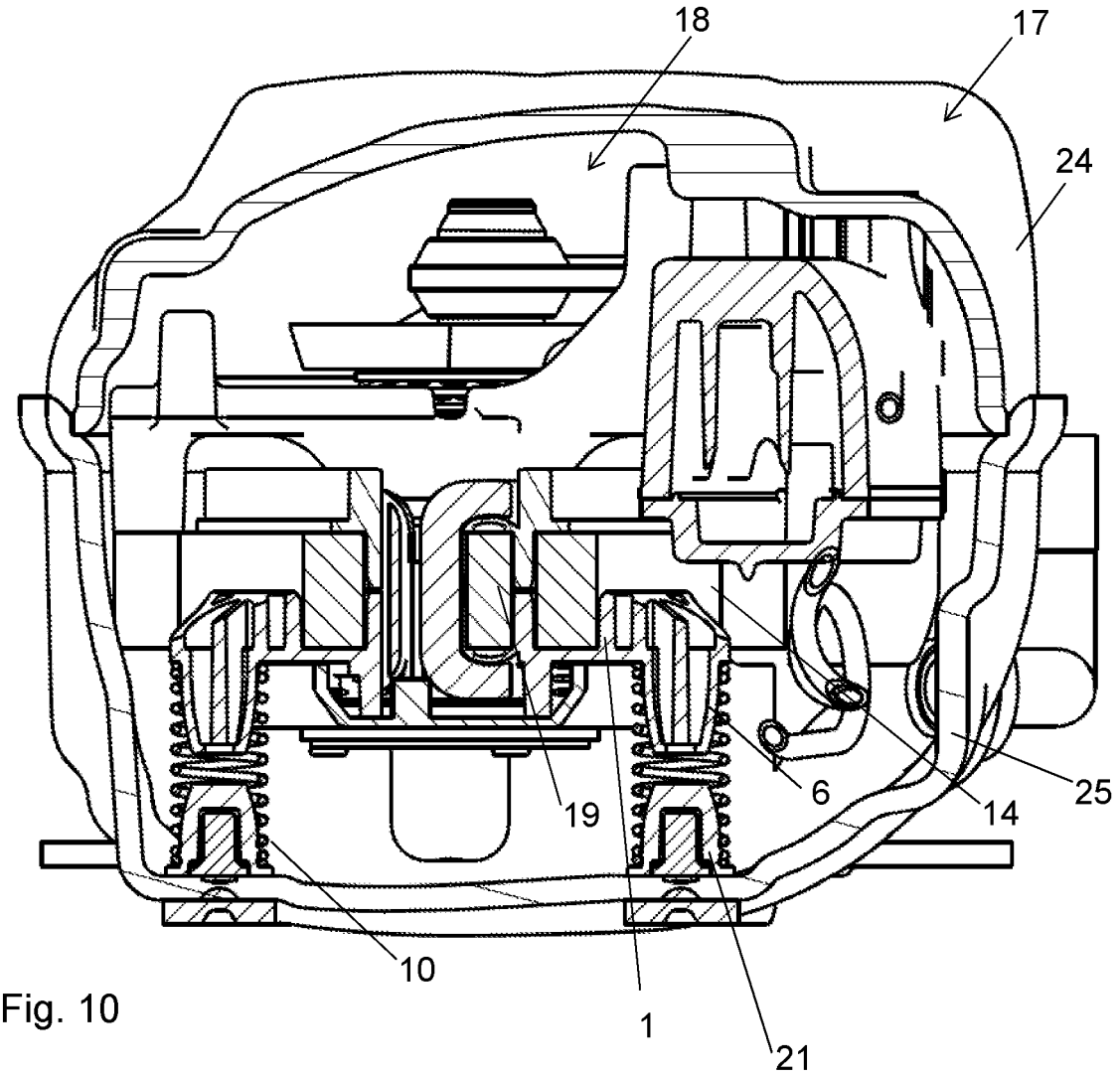
Figure 11:
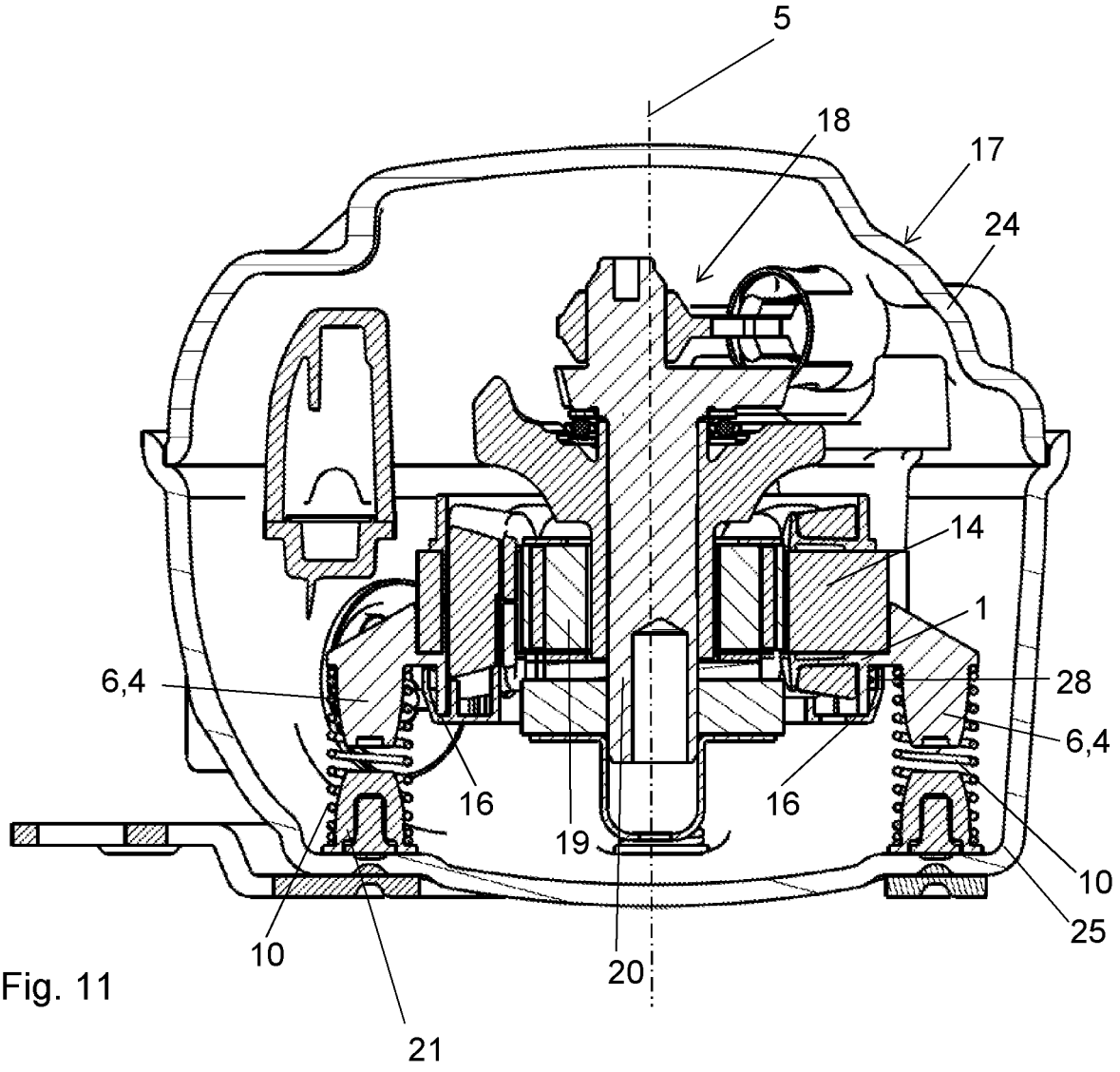

FIGS. 9, 10 and 11 show a refrigerant compressor with a hermetically closed housing 17, here comprising an upper housing part 24 which is welded to a lower housing part 25. Via four helical springs 10 the drive unit 18 is supported on the lower housing part 25 of the housing 17, or rather on its bottom. The drive unit 18 comprises a piston/cylinder unit and the electric motor. The electric motor has a stator 14 and a rotor 19. The rotor 19 is unrotatably connected to a crank shaft 20 and rotates inside a central opening of the stator 14. The rotor 19 here is an IPM (internal permanent magnet) rotor. The end element 1 is mounted on the lower axial end portion of the stator 14.

In the bottom of the refrigerant compressor second spring holders 21 are located, on which the helical springs 10 are mounted. The second spring holders 21 comprise substantially cylindrical sections. Also the insertion part 6 of the spring holder 3 has at least partially a cylindrical form for insertion into the helical spring 10. The end of the insertion part 6 of the spring holder 3 has at least partially an approximate frustoconical form.

In extreme vertical load situations the insertion part 6 of spring holder 3 contacts the second spring holder 21 which gives additional stability to the drive unit 18.

In FIG. 11 the section plane includes the axis 5 of the stator 14 and two spring holders, which means that the section plane of FIG. 11 is turned by 45° with relation to the section plane of FIG. 9. It can be seen in FIG. 11 that the cover element 16 separates connection wires 28 from the helical springs 10.

Figure 12:
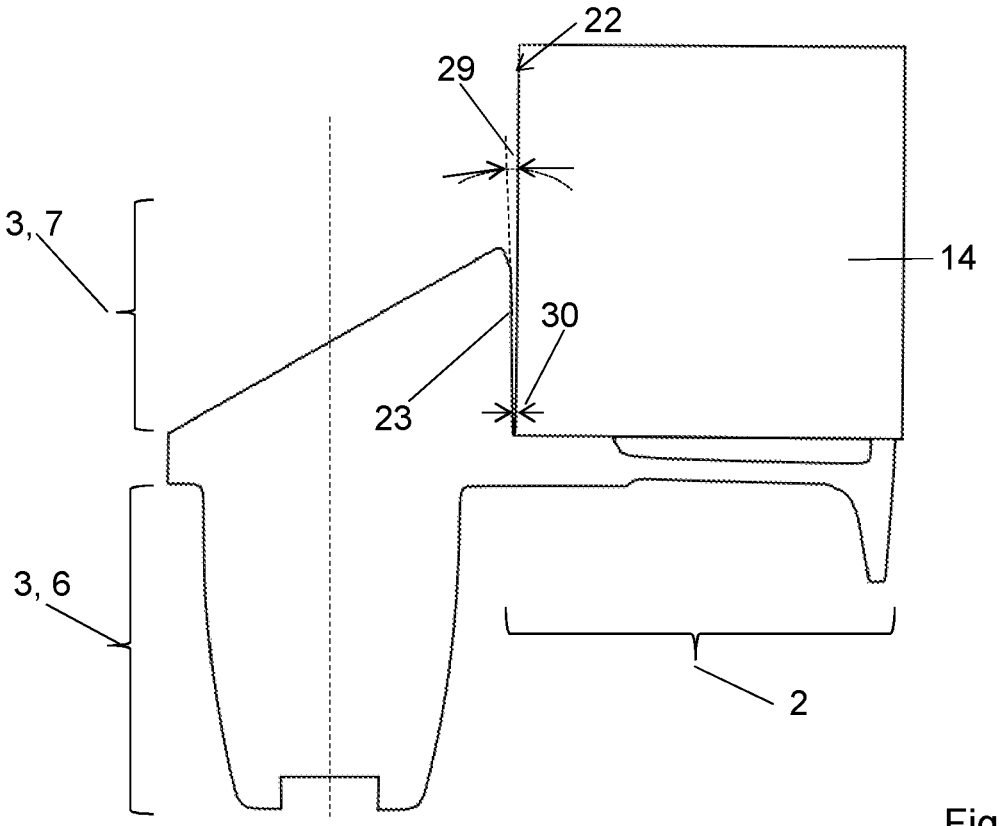
Figure 13:
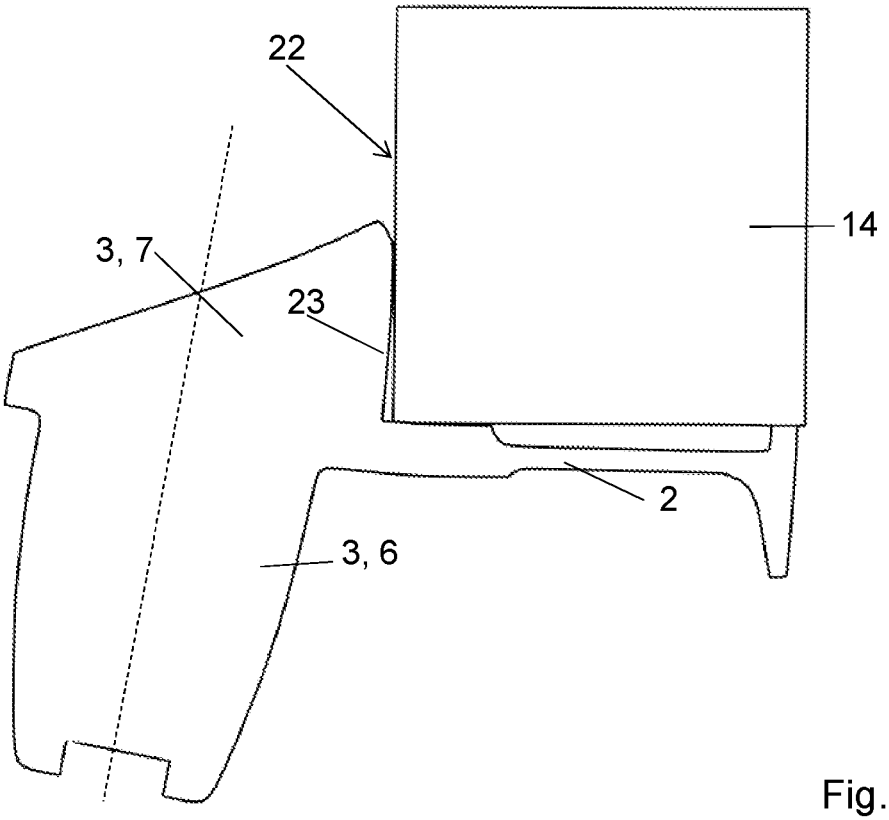

In FIGS. 12 and 13 the actual displacement of spring holder 3 has been increased by a factor of 30 to better show the end element 1 in its loaded and thus deformed shape. FIG. 12 shows one spring holder 3 which is tiltable with relation to the isolating element 2. In FIG. 12 the drive unit 18 is not loaded so the extended part 7, namely its side 23, has a radial distance 30 to the lateral surface 22 of stator 14 (only a part of stator 14 is depicted here and in FIG. 13). So in this situation the end element 1, namely the isolating element 2, contacts the stator 14 only at its front end. The radial distance 30 between extended part 7 of spring holder 3, i.e. its side 23, and lateral surface 22 of the stator core of stator 14 here is approximately 0.1 mm at the bottom of the extended part 7. This means that the radius of the circular arc of the side 23 is at least 0.1 mm larger than the radius of the stator 14. This radial distance 30 is needed to allow for mounting the end element 1 to the stator 14 and for tilting the extended part 7 radially inwards.

Generally, in this unloaded first position, side 23 and lateral surface 22 can be parallel to each other or they can be arranged in an angle to each other, as in FIG. 12. This draft angle 29 should be smaller than the tilt angle. In FIG. 12 the side 23 is tilted radially outwards by a draft angle 29 of 0.5°. This means that the radius of the side 23 is growing with growing axial distance from the isolating element 2, i.e. in the direction vertically upwards. So the radial distance 30 between side 23 of extended part 7 and stator 14 is not constant along the axial direction, it increases starting from 0.1 mm at the bottom of extended part 7. In FIG. 12 the axis of the spring holder 3 is depicted as a dotted line and is vertical.

In FIG. 13 the stator 14 is loaded, e.g. pressed downwards against the section of the isolating element 2 contacting the stator 14 on its end face. The spring holder 3 tilts inside from the first position to the second position so the side 23 of the extended part 7 touches the lateral surface 22 of stator 14 and thus embraces the stator 14 at its lateral side 22. The axis of the spring holder 3 is again depicted as a dotted line. The angle between the axis of the spring holder 3 and the vertical is the tilt angle. The spring holder 3, and its side 23, is tilted in the amount of the tilt angle against the vertical direction, i.e. against the first position of FIG. 12. A typical tilt angle for small compressors would be 1.25°.

LIST OF REFERENCE SYMBOLS

1 end element
2 isolating element
3 spring holder
4 stiffening rib
5 axis
6 insertion part
7 extended part
8 first axial direction
9 second axial direction
10 helical spring
11 rim
12 web
13 protrusions
14 stator
15 upper end element
16 cover element
17 housing
18 drive unit
19 rotor
20 crank shaft
21 second spring holder
22 lateral surface
23 side of extended part 7
24 upper housing part
25 lower housing part
26 angular range of the circular arc of side 23
27 angular range of the insertion part 6
28 connection wires
29 draft angle
30 radial distance

The invention claimed is:

1. An end element for a stator of an electric motor of a hermetically sealed refrigerant compressor, whereas the end element comprises at least one isolating element which is adapted to cover an axial end portion of the stator and to isolate a stator core and stator windings, whereas the isolating element has a ring-like structure, whereas the end element comprises more than one spring holder, each spring holder being adapted to hold a spring for supporting the electric motor in a housing of the hermetically sealed refrigerant compressor, whereas the spring holders extend radially outside the isolating element, whereas the spring holders are oriented parallel to an axis of the isolating element and an insertion part of each spring holder extends in a first axial direction beyond neighboring area of the isolating element, whereas the spring holders and the isolating element are integral parts of the end element, wherein the spring holders are tiltable with relation to the isolating element so that an extended part of a spring holder, which extended part extends in a second axial direction beyond the neighboring area of the isolating element, can tilt radially inwards so that in an operational state of the end element, the extended part of the spring holder can contact a lateral surface of the stator core.

2. The end element according to claim 1, wherein the spring holder includes a hollow body with at least one stiffening rib inside the hollow body extending from one side wall to the opposing side wall of the hollow body.

3. The end element according to claim 2, wherein the stiffening rib extends radially.

4. The end element according to claim 1, wherein at a side facing the isolating element, a cross section of the extended part has a form of a circular arc.

5. The end element according to claim 4, wherein an angular range of the circular arc, measured with reference to the ring-like isolating element, is between 10° and 40°.

6. The end element according to claim 4, wherein an angular range of the circular arc, measured with reference to the ring-like isolating element, is between 25° and 35°.

7. The end element according to claim 4, wherein the side of the extended part facing the isolating element is tilted radially outwards by a draft angle so that a radius of the side is growing with growing axial distance from the isolating element.

8. The end element according to claim 1, wherein the extended part broadens in the direction radially inwards.

9. The end element according to claim 1, wherein each spring holder is partially enclosed by a rim which extends to a web oriented normal to the axis of the isolating element and additionally connects the spring holder in a symmetric manner to the isolating element.

10. The refrigerant compressor comprising a hermetically sealed housing and a drive unit disposed in the interior of the housing, the drive unit comprising the electric motor with the stator, wherein an end element according to claim 1 is mounted on the stator, whereas the end element comprises at least one isolating element which covers the axial end portion of the stator and isolates the stator core and the stator windings, whereas each spring holder holds the spring which supports the electric motor in the housing of the hermetically sealed refrigerant compressor, whereas the extended part of the spring holders in a first position with relation to the stator, when the refrigerant compressor is not loaded, each extended part having a radial distance to the lateral surface of the stator core, and whereas the extended part of at least one spring holder in a second position with relation to the stator, when the refrigerant compressor is loaded, contacts the lateral surface of the stator core due to a tilt radially inward from the first position into the second position.

11. The refrigerant compressor according to claim 10, wherein a tilt angle between first position and second position is in the range between 1° and 10°.

12. The refrigerant compressor according to claim 10, wherein a tilt angle between first position and second position is in the range between 1° and 5°.

13. The refrigerant compressor according to claim 10, wherein a tilt angle between first position and second position is in the range between 1° and 3°.

14. The refrigerant compressor according to claim 10, wherein in the first position the radial distance between the extended part of the spring holders and the lateral surface of the stator core is less than 1 mm.

15. The refrigerant compressor according to claim 10, wherein in the first position the radial distance between the extended part of the spring holders and the lateral surface of the stator core is less than 0.5 mm.

16. The refrigerant compressor according to claim 10, wherein in the first position the radial distance between the extended part of the spring holders and the lateral surface of the stator core is equal to or more than 0.1 mm.

17. The refrigerant compressor according to claim 10, wherein in the first position the side of extended part facing the isolating element is tilted radially outwards by a draft angle so that the radius of the side is growing with growing axial distance from the isolating element.

* * * * *